US006532607B1

(12) United States Patent
Heil

(10) Patent No.: US 6,532,607 B1
(45) Date of Patent: Mar. 18, 2003

(54) BODY LIFT

(76) Inventor: Arlan Dean Heil, 16411 Creek South, Houston, TX (US) 77068

( * ) Notice: Subject to any disclaimer, the term of this patent is extended or adjusted under 35 U.S.C. 154(b) by 0 days.

(21) Appl. No.: 09/966,780

(22) Filed: Sep. 28, 2001

(51) Int. Cl.[7] ..... A61G 7/10

(52) U.S. Cl. ..... 5/85.1; 5/81.1 R; 5/83.1; 601/23; 212/250; 128/845

(58) Field of Search ..... 5/81.1 R, 85.1, 5/84.1, 83.1, 89.1; 212/250; 601/23; 128/845

(56) References Cited

U.S. PATENT DOCUMENTS

| | | | | | |
|---|---|---|---|---|---|
| 3,072,400 | A | * | 1/1963 | Dykinga | 482/102 |
| 3,123,224 | A | * | 3/1964 | Kral | 212/330 |
| 4,159,010 | A | | 6/1979 | Mitro | 119/96 |
| 4,202,064 | A | | 5/1980 | Joergensen | 5/83 |
| 4,243,147 | A | * | 1/1981 | Twitchell et al. | 104/172.1 |
| 4,606,082 | A | | 8/1986 | Kuhlman | 4/561 |
| 4,627,119 | A | | 12/1986 | Hachey et al. | 5/83 |
| 4,928,330 | A | | 5/1990 | Moore | 4/562 |
| 5,123,131 | A | | 6/1992 | Jandrakovic | 5/81.1 |
| 5,158,188 | A | | 10/1992 | Nordberg | 212/209 |
| 5,327,592 | A | | 7/1994 | Stump | 5/81.1 |
| 5,456,655 | A | | 10/1995 | Morris | 601/23 |
| 5,490,293 | A | | 2/1996 | Nilsson | 5/83.1 |
| 5,511,256 | A | | 4/1996 | Capaldi | 5/83.1 |
| 5,558,022 | A | | 9/1996 | Mason et al. | 104/126 |
| 5,601,527 | A | * | 2/1997 | Selkowitz | 254/413 |
| 5,903,934 | A | | 5/1999 | Sears, III | 4/538 |
| 5,939,857 | A | * | 8/1999 | Madigan et al. | 320/107 |
| 6,079,578 | A | * | 6/2000 | Dyson | 104/89 |
| 6,175,973 | B1 | | 1/2001 | Hakamiun et al. | 5/89.1 |
| 6,315,138 | B1 | * | 11/2001 | Dyson | 104/89 |

FOREIGN PATENT DOCUMENTS

| | | | | |
|---|---|---|---|---|
| FR | 2668925 | A1 | * 11/1990 | A61H/1/00 |

* cited by examiner

*Primary Examiner*—J. J. Swann
*Assistant Examiner*—Katherine Mitchell
(74) *Attorney, Agent, or Firm*—Guy McClung

(57) ABSTRACT

A movement system for moving a person. In at least certain aspects, the system has a power apparatus and primary line apparatus connected to the power apparatus. The power apparatus selectively moves or plays out and takes in the primary line apparatus. One or a plurality of secondary lines are connected to the primary line apparatus In those embodiments with a plurality of secondary lines, the secondary lines diverge from each other and extend to a corresponding movement station in a structure. The or each secondary line has a distal end extending into its corresponding movement station for connection to a personal support apparatus around a person, and the or each secondary line is movable by the power apparatus to move a person to whose personal support apparatus the or each secondary line is attached.

19 Claims, 3 Drawing Sheets

BODY LIFT

BACKGROUND OF THE INVENTION

1. Field of the Invention

This invention is directed to apparatuses for assisting the movement of a person and, in certain aspects, to apparatus for lifting and lowering a person with respect to, e.g., a bed, a chair, a vehicle, or a commode.

2. Description of Related Art

The prior art discloses a wide variety of supports, lifts, and movement assistance apparatuses for helping handicapped persons, patients in healthcare facilities, and invalids move and for helping caregivers move or aid in the movement of such persons. The prior art provides such apparatuses for various situations e.g., movement into and out of a tub or shower areas; movement into and out of a vehicle; movement with respect to a commode; and movement with respect to a bed or chair.

Certain person movement apparatuses require a substantial and complex support structure in addition to already existing walls, foundations, and supports. Many personal movement apparatuses are confined to a single area and do not service multiple stations in a single place, e.g., in a house or hospital there are separate movement apparatuses adjacent commodes and adjacent beds.

There has long been a need for a movement apparatus that is easily installed in existing structures, including, but not limited to, in homes or hospitals. There has long been a need for such a an apparatus that can service multiple stations in the same building or location. There has long been a need for such apparatuses which is easily adjustable and easily connected to body support apparatus.

SUMMARY OF THE PRESENT INVENTION

The present invention discloses a movement system for moving a person, the movement system in certain aspects having power apparatus, primary line apparatus connected to the power apparatus, the power apparatus for selectively moving the primary line apparatus, at least one or a plurality of secondary lines connected to the primary line apparatus, the at least one or more secondary lines each extending to a corresponding movement station in a structure, the one or more secondary lines each having a distal end extending into a corresponding movement station for connection to personal support apparatus for moving a person, and the one or more secondary lines movable by the power apparatus for moving a person to whose personal support apparatus the at least one secondary line is attached.

The present invention, in certain embodiments, discloses a personal movement apparatus which has a central power device or machine from which extend and to which are connected a plurality of lines or cables. The lines diverge and are available in, and in certain aspects are positioned above and extend down into, one or a plurality of stations in and/or adjacent a building, house, hospital, or other facility or structure. Ends of the lines extend down from above into the area of each station for easy and quick attachment to a support harness or sling. A person can be moved, lifted, and/or lowered from one place at that station to another place. For example, and not by way of limitation, a person may be moved from a sitting position in a chair to a standing position; from a standing position near a commode to sitting position on a commode; or from a reclining position in a bed to a sitting position in the bed or to a standing position by the bed.

In one particular embodiment a lead line or lead rope extends from a power device or machine that selectively moves, and/or takes in and plays out the lead line or lead rope. The power device is located in any convenient location and may be on ground level if appropriate line direction changing hardware, pulleys, and/or rings are used in one aspect the power device is located above a plurality of rooms. From the lead line or lead rope extend a plurality of secondary lines each of which has a distal end available in each of the plurality of rooms for attachment to a personal support apparatus or sling for facilitating personal movement in each room.

In certain aspect there is a central control, wired and/or wireless, that controls the main power device and thus controls the lines going to each location in a facility. In other aspects there is a control device in each location to which a secondary line extends. In other aspects there is a hand-held or personal control device, wired or wireless, which may be used by a caregiver or assistant of by the person being moved.

It is, therefore, an object of at least certain preferred embodiments of the present invention to provide:

New, useful, unique, efficient, nonobvious personal movement apparatuses;

Such apparatuses with multiple support lines for multiple stations in a single facility;

Such apparatuses which are easily installed in existing structures and which, in certain aspects, can use existing structural support members; and Methods for using such apparatuses.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
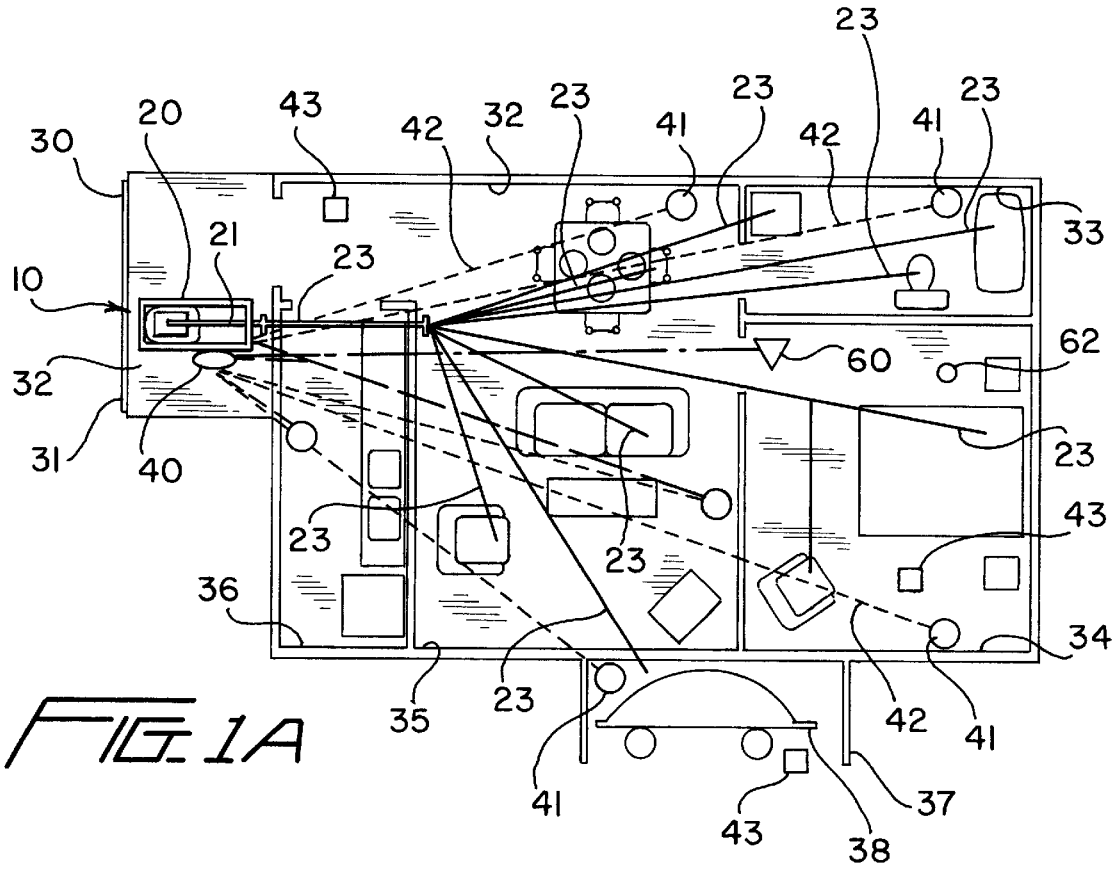
FIG. 1A is a top schematic perspective view of a system according to the present invention.

FIG. 1A shows a system 10 according to the present invention with a central power apparatus 20 mounted in a ceiling 32 above a room 31 of a multi-room house 30. Of course it is to be understood that such a system may be used in any structure, building, hospital, apartment, health care location or facility for movement of a person. The house 30 has additional rooms 32–36 and a carport, garage or vehicle parking area 37 with a vehicle 38. A lead line, cable, or rope 21 extends from the power apparatus 20 to a first ring (or pulley or bearing) 22. Connected to the lead line 21 are a plurality of secondary lines 23 which extend from the lead line 21, to and through a second ring 24 (which may be mounted at any desirable location), and then to a pulley, ring, or other mounting hardware 25 in the ceiling of each room and in the carport area from which they extend downwardly into the room or area.

Figure 1B:
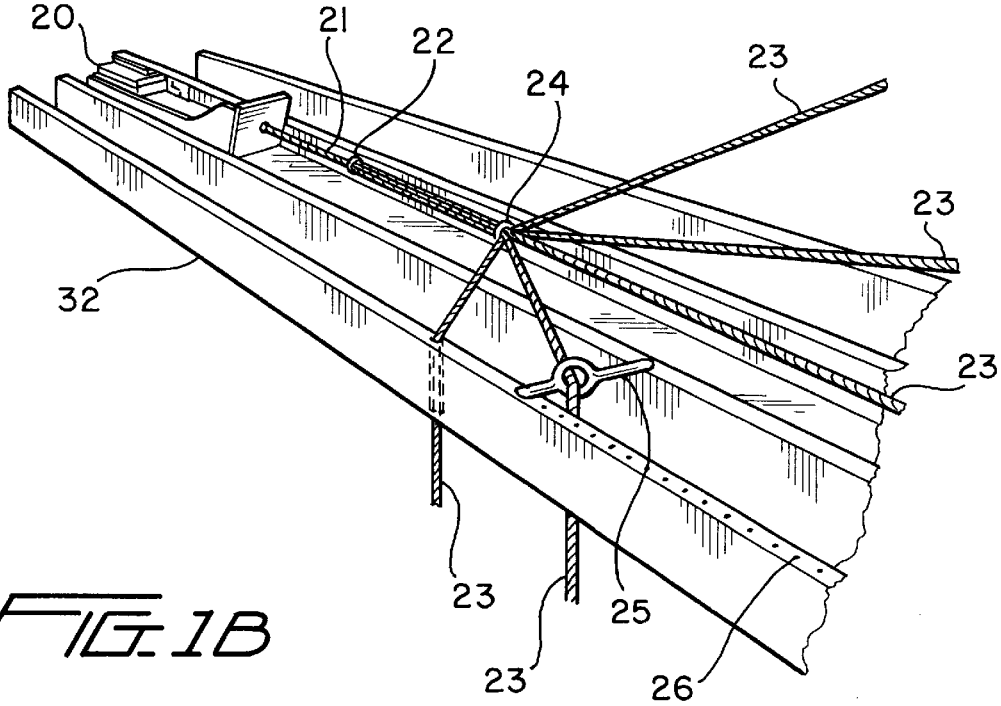
FIG. 1B is a perspective view of a power device for a system according to the present invention.

Alternatively the secondary lines may pass through holes in joists or beams (e.g. like the hole 23*a*, FIG. 1B). Appropriate slots 26 or other openings may be provided in the ceilings to accommodate movement of the secondary lines when they are being attached to a harness or sling and/or when the power apparatus 20 is operating. Alternatively, the lead rope may extend to and through the ring 24; optionally, additional rings may be used; and/or the secondary lines may extend through the ring 24.

Although the power apparatus is shown positioned in or above a ceiling, it is within the scope of this invention for the power apparatus to be located anywhere and for the line(s) that it moves to be run from a lower position up to a point above a movement station using appropriate hardware and/or line directing apparatus.

A control system 40 has room controllers 41 in each room or area so that a person in each room or area can selectively activate and deactivate the power apparatus 20 to raise or lower a person. Wired connections 42 may be used between the room controllers 41 or wireless remote control apparatus (es) 43 (positionable in any room or area) may be used.

As shown the secondary lines 23 exit the room ceilings at points adjacent: a shower in room 33, a dining chair in room 32, a sofa in room 35, an easy chair in room 35, a bed in room 34, an easy chair in room 34, and a car in area 37. However, it is within the scope of this invention to use a system according to the present invention like the system 10 in any location for working a person. It is also within the scope of this invention to delete any of the secondary lines, any combination of them (leaving at least one), or to delete all of them but one. The apparatus 20 as shown is a typical garage door opener apparatus, e.g. but not limited to, those commercially available from Chamberlain Company. The lead line 21 may wind and unwind from a reel (not shown) or (see FIG. 3) it may be connected to a member 29 on the apparatus that is moved back and forth by a power apparatus 20 (or 20*a* FIG. 3). Any suitable powered apparatus, device, or machine may be used to play out and take in the lead line 21. Alternatively, according to the present invention, the lead line 21 is manually accessible in the room 31 and a person at an end of one of the secondary lines 23 is hoisted and lowered manually by using the lead line 21, with or without cranking apparatus, reel apparatus, and/or pulley(s). In one aspect both powered and manual modes are available.

Figure 2A:
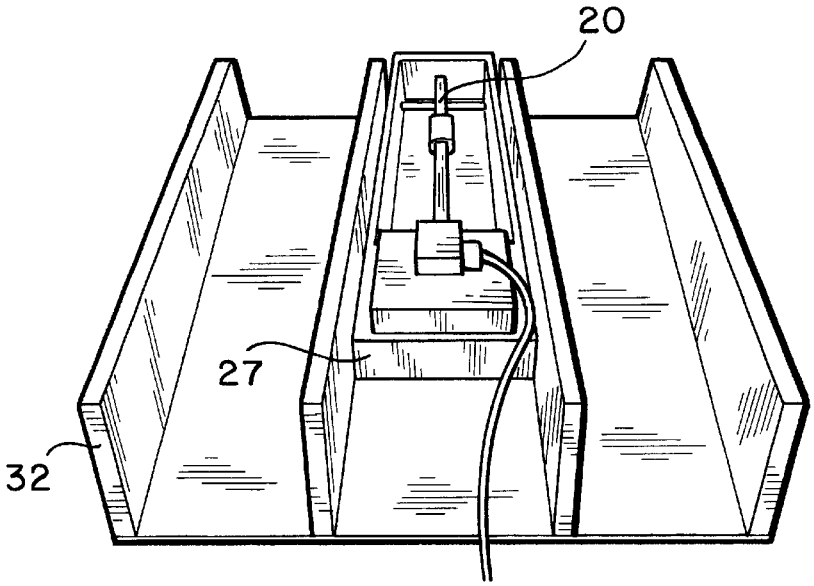
FIG. 2A is a perspective end view of a power device for a system according to the present invention.
Figure 2B:
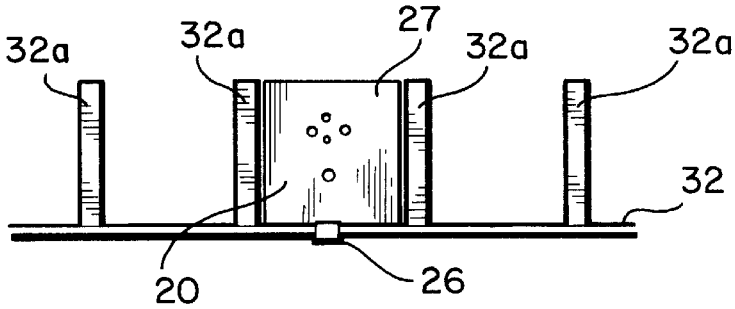
FIG. 2B is an end view of the device of FIG. 2A.

FIGS. 2A and 2B show the power apparatus 20 mounted in the ceiling 32, between ceiling joists or beams 32*a*. Optionally a grommet 26 is used to facilitate movement of lines through holes in ceiling materials such as sheetrock and/or to provide a passage way through ceiling materials for a power cord for the power apparatus.

Figure 3:
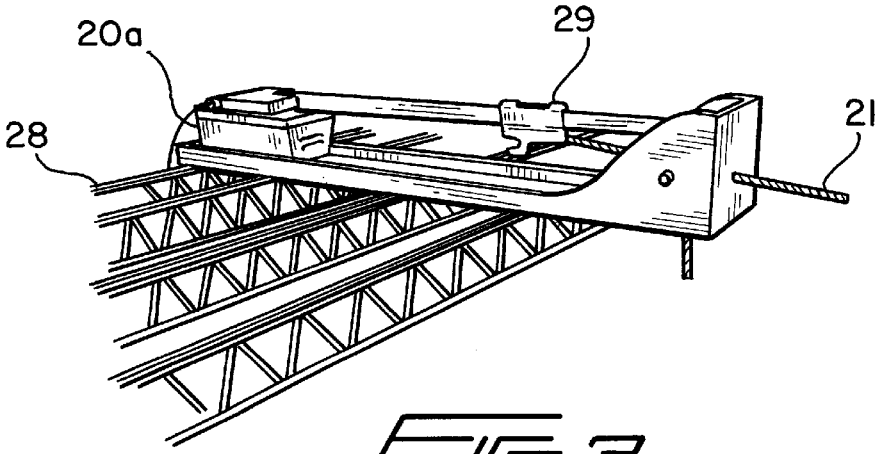
FIG. 3 is a perspective view of a power device for use in a system according to the present invention.

FIG. 3 shows a power apparatus 20*a* for a system according to the present invention (like the power apparatus 20, FIG. 1B) resting on and secured to ceiling girders or beams 28.

Figure 4:
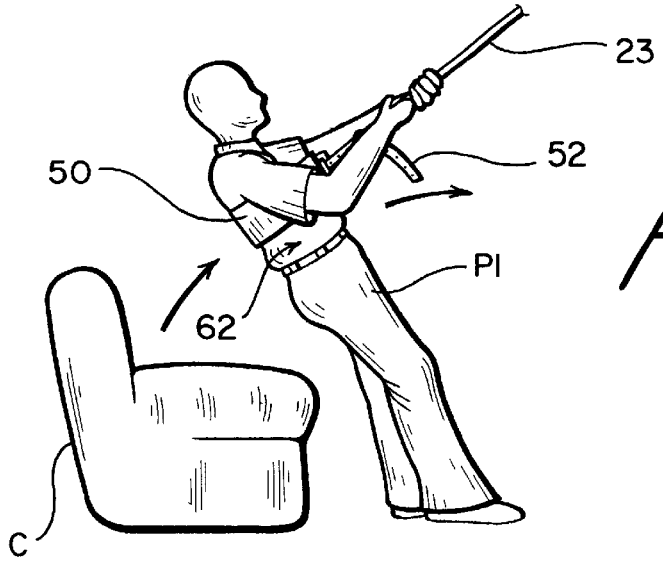
FIG. 4 is a side view showing a person being moved with system according to the present invention.
Figure 6:
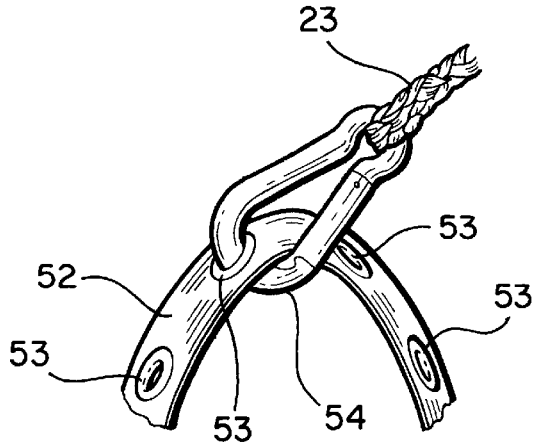
FIG. 6 is a perspective view of part of a harness for use with systems according to the present invention.

FIG. 4 shows a person P1 with a body harness 50 having a strap 52 connected to a secondary line 23 of the system 10 being moved up from a chair C by operation of the power apparatus 20. As shown in FIG. 6, the strap 52 has a plurality of spaced-apart openings 53 and a releasable clip 54 extends through one of the openings 53. A secondary line 23 is secured to the clip 54.

Figure 5A:
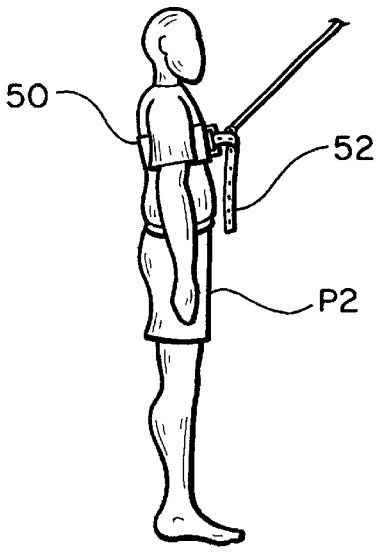
FIGS. 5A and 5B are side views of persons to be moved with a system according to the present invention.
Figure 5B:
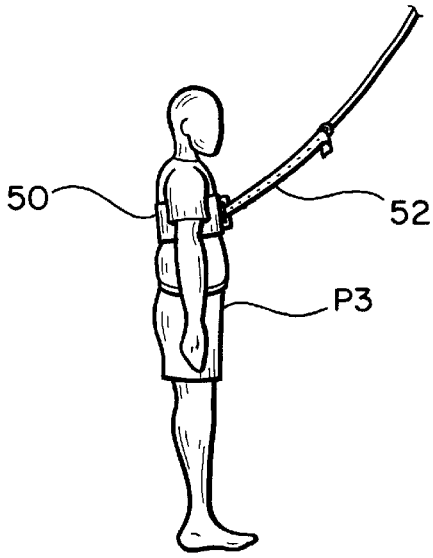

As shown in FIGS. 5A and SB persons P2 and P3 (P2 is taller than P3) each with a harness 50 have a secondary line connected to one of the openings 53 in the strap 52; thus the connection between the secondary line 23 and a person to be moved can be adjusted depending on the person's height.

The control system 40 may be any suitable known electronic control system for controlling via wire and/or remotely a power apparatus like the power apparatus 20. Optionally, a time delay, e. g. of a few seconds may be provided between the time a person pushes a button or otherwise activates the system and the time lifting or lowering of the person commences. Also, optionally, the control system (which may include a computer, computers, or programmed electronic controls) may be set or programmed to provide power to the power apparatus for a specific time period so that the power apparatus is always shut off after the lead line has moved a predetermined distance, e.g. two, three, four or five feet. Also, optionally, a kill switch (wired 60 or wireless 62, FIGS. 1A and 4 respectively) may, according to certain embodiments of the present invention, be provided in each room and/or for each person in a house, facility, etc. for instant system deactivation.

For adjustment of movement a rope with loops, a line with loops, or a piece of chain may be used between a person and a secondary line 23. Secondary lines may be sufficiently long that they extend from an attic or ceiling area in a multi-story structure through one or more floors to a floor on which person movement is accomplished.

In certain aspects the travel distance of the lead line is between five and six feet and in one particular aspect it is five feet, six inches.

The present invention, therefore, provides in certain, but not necessarily all embodiments, a movement system for moving a person, the movement system including power apparatus, primary line apparatus connected to the power apparatus, the power apparatus for selectively moving the primary line apparatus, at least one secondary line connected to the primary line apparatus, the at least one secondary line extending to a corresponding movement station in a structure, the at least one secondary line having a distal end extending into a corresponding movement station for connection to personal support apparatus for moving a person, and the at least one line movable by the power apparatus for moving a person to whose personal support apparatus the at least one secondary line is attached. Such a system may have one or some (in any possible combination) of the following: a plurality of movement stations and the at least one secondary line is a plurality of secondary lines, each secondary line of the plurality of secondary lines extending to a corresponding movement station; the power apparatus and primary line apparatus positioned above the movement station in the structure; wherein the at least one secondary line extends from the primary line down into its corresponding movement station; guiding apparatus through which the primary line passes for guiding the primary line as it moves; wherein the guiding apparatus comprises at least one ring through which the primary line passes and with respect to which the primary line is movable by the power apparatus; wherein the primary line is movable a distance between five and six feet; wherein the at least one ring is two spaced-apart rings; wherein the structure includes a plurality of rooms and the at least one secondary line includes a plurality of secondary lines, each secondary line extending down into one of the rooms; the personal support apparatus, the personal support apparatus comprising a body harness releasably connectable around a person's body; a length-adjustable strap interconnected between the body harness and the at least one secondary line; control apparatus for selectively controlling the power apparatus; wherein the control apparatus includes a remote control device for remotely selectively operating the control apparatus; multiple spaced-apart operation units in the structure for operating the control apparatus; wherein the multiple spaced-apart operation units are connected by wiring to the control apparatus;the structure, the structure including vehicle storage area, and the at least one secondary line extending to the vehicle storage area for assisting a person in entering and exiting the vehicle; the structure, ceiling members in an upper part of the structure, and the power apparatus mounted to the ceiling members; wherein a ceiling member has a hole through it and the at least one secondary line passes through the hole down to a movement station.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A movement system for moving a person, the movement system comprising power apparatus, primary line apparatus connected to the power apparatus, the power apparatus for selectively moving the primary line apparatus, at least one secondary line connected to the primary line apparatus, the at least one secondary line extending to a corresponding movement station in a structure, the at least one secondary line having a distal end extending into a corresponding movement station for connection to a personal support apparatus for moving a person, and the at least one secondary line movable by the power apparatus for moving a person to whose personal support apparatus the at least one secondary line is attached.

2. The movement system of claim 1 wherein there are a plurality of movement stations and the at least one secondary line is a plurality of secondary lines, each secondary line of the plurality of secondary lines extending to a corresponding movement station.

3. The movement system of claim 1 further comprising the power apparatus and primary line apparatus positioned above the movement station in the structure.

4. The movement system of claim 3 wherein the at least one secondary line extends from the primary line down into its corresponding movement station.

5. The movement system of claim 1 further comprising guiding apparatus through which the primary line passes for guiding the primary line as it moves.

6. The movement system of claim 5 wherein the guiding apparatus comprises at least one ring through which the primary line passes and with respect to which the primary line is movable by the power apparatus.

7. The movement system of claim 6 wherein the primary line is movable a distance between five and six feet.

8. The movement system of claim 6 wherein the at least one ring is two spaced-apart rings.

9. The movement system of claim 1 wherein the structure includes a plurality of rooms and the at least one secondary line includes a plurality of secondary lines, each secondary line extending down into one of the rooms.

10. The movement system of claim 1 further comprising the personal support apparatus, the personal support apparatus comprising a body harness releasably connectable around a person's body.

11. The movement system of claim 10 further comprising a length-adjustable strap interconnected between the body harness and the at least one secondary line.

12. The movement system of claim 1 further comprising control apparatus for selectively controlling the power apparatus.

13. The movement system of claim 12 wherein the control apparatus includes a remote control device for remotely selectively operating the control apparatus.

14. The movement system of claim 12 further comprising multiple spaced-apart operation units in the structure for operating the control apparatus.

15. The movement system of claim 14 wherein the multiple spaced-apart operation units are connected by wiring to the control apparatus.

16. The movement system of claim 1 further comprising the structure, the structure including a vehicle storage area, and the at least one secondary line extending to the vehicle storage area for assisting a person in entering and exiting a vehicle in the vehicle storage area.

17. The movement system of claim 1 further comprising the structure, ceiling members in an upper part of the structure, and the power apparatus mounted to the ceiling members.

18. The movement system of claim 17 wherein a ceiling member of said ceiling members in an upper part of the structure has a hole through it and the at least one secondary line passes through the hole down to a movement station.

19. A movement system for moving a person, the movement system comprising a power apparatus, primary line apparatus connected to the power apparatus, the power apparatus for selectively moving the primary line apparatus, at least one secondary line connected to the primary line apparatus, the at least one secondary line extending to a corresponding movement station in a structure, the at least one secondary line having a distal end extending into a corresponding movement station for connection to personal support apparatus for moving a person, and the at least one secondary line movable by the power apparatus for moving a person to whose personal support apparatus the at least one secondary line is attached, wherein there are a plurality of movement stations and the at least one secondary line is a plurality of secondary lines, each secondary line of the plurality of secondary lines extending to a corresponding movement station, the power apparatus and primary line apparatus positioned above the movement station in the structure, guiding apparatus through which the primary line passes for guiding the primary line as it moves, wherein the primary line is movable a distance between five and six feet, the personal support apparatus, the personal support apparatus comprising a body harness releasably connectable around a person's body, a length-adjustable strap interconnected between the body harness and the at least one secondary line, and control apparatus for selectively controlling the power apparatus.

* * * * *